US010668732B2

(12) United States Patent
Yokoi

(10) Patent No.: US 10,668,732 B2
(45) Date of Patent: Jun. 2, 2020

(54) INK TANK AND INK JET RECORDING APPARATUS

(71) Applicant: CANON KABUSHIKI KAISHA, Tokyo (JP)

(72) Inventor: Katsuyuki Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/111,067

(22) Filed: Aug. 23, 2018

(65) Prior Publication Data

US 2019/0061360 A1 Feb. 28, 2019

(30) Foreign Application Priority Data

Aug. 31, 2017 (JP) ..... 2017-167755

(51) Int. Cl.
*B41J 2/175* (2006.01)
*B41J 29/13* (2006.01)
*B41J 29/02* (2006.01)

(52) U.S. Cl.
CPC ..... *B41J 2/17506* (2013.01); *B41J 2/1752* (2013.01); *B41J 2/17509* (2013.01); *B41J 2/17513* (2013.01); *B41J 2/17523* (2013.01); *B41J 2/17553* (2013.01); *B41J 2/17566* (2013.01); *B41J 29/02* (2013.01); *B41J 29/13* (2013.01)

(58) Field of Classification Search
CPC ..... B41J 2/17506; B41J 2/1752; B41J 29/13; B41J 2/17566; B41J 2/17513; B41J 2/17509; B41J 29/02; B41J 2/17553; B41J 2/17523
See application file for complete search history.

(56) References Cited

U.S. PATENT DOCUMENTS 6,145,972 A * 11/2000 Udagawa ..... B41J 2/17513 347/86
7,360,877 B2 * 4/2008 Ikezaki ..... B41J 2/17509 347/85
10,166,780 B2 * 1/2019 Shinoda ..... B41J 2/16508
2015/0210081 A1 * 7/2015 Suzuki ..... B41J 2/175 347/86

(Continued)

FOREIGN PATENT DOCUMENTS

JP H10-193634 A 7/1998
JP 2015-164812 A 9/2015

(Continued)

*Primary Examiner* — Huan H Tran

(74) *Attorney, Agent, or Firm* — Canon U.S.A. Inc., IP Division

(57) ABSTRACT

An ink tank includes a storage chamber formed of a front face wall, a back face wall, a first side wall, a second side wall, a top plate, and a bottom plate, an injection port, a partition wall connected to the first side wall and the second side wall, a first space surrounded by the back face wall, the first side wall, and the second side wall, and a second space surrounded by the front face wall, the first side wall, and the second side wall are formed by the partition wall, and wherein the injection port is arranged on a side of the first space, and a communication portion that communicates the first space and the second space is formed at a position between the partition wall and the bottom plate.

10 Claims, 19 Drawing Sheets

(56) References Cited

U.S. PATENT DOCUMENTS

| | | | | |
|---|---|---|---|---|
| 2015/0367648 | A1* | 12/2015 | Kimura | B41J 2/17509 347/86 |
| 2016/0193847 | A1* | 7/2016 | Suzuki | B41J 2/175 347/86 |
| 2016/0252286 | A1* | 9/2016 | Jeong | F25C 1/18 62/130 |
| 2017/0129246 | A1* | 5/2017 | Kimura | B41J 2/17509 |
| 2017/0274663 | A1* | 9/2017 | Kanaya | B41J 2/175 |
| 2018/0056662 | A1* | 3/2018 | Shinoda | B41J 2/16508 |
| 2019/0061363 | A1* | 2/2019 | Sawadaishi | B41J 2/175 |

FOREIGN PATENT DOCUMENTS

| | | | |
|---|---|---|---|
| JP | 2017-94510 | A | 6/2017 |
| JP | 2018-30292 | A | 3/2018 |

* cited by examiner

INK TANK AND INK JET RECORDING APPARATUS

BACKGROUND OF THE INVENTION

Field of the Invention

The present disclosure relates to an ink tank having an injection port through which ink is injected and an ink jet recording apparatus including the ink tank.

Description of the Related Art

A printer discussed in Japanese Patent Application Laid-Open No. 2015-164812 includes a tank having an ink injection portion for injecting ink and a printing head for discharging ink supplied from the tank. A partition wall which guides and introduces ink injected from the ink injection portion arranged on the front face side of the tank to a back face wall of the tank is provided on the internal portion of the tank. With this configuration, when a user injects ink thereto, dropping ink can be suppressed from spattering on a front face wall of the tank, so that the user can precisely see a liquid surface of the ink within the tank.

However, in the apparatus described in Japanese Patent Application Laid-Open No. 2015-164812, if air bubbles generated from the injected ink dropping onto the partition wall move to the side of the front face wall of the tank, it will be difficult for the user to see the liquid surface inside the tank.

SUMMARY OF THE INVENTION

The present disclosure is directed to an ink jet recording apparatus capable of suppressing lowering of visibility of a liquid surface of ink retained in an ink tank, which is caused by air bubbles generated when ink is injected from an injection port.

According to an aspect of the present disclosure, an ink tank which is arranged on an ink jet recording apparatus includes a storage chamber formed of a front face wall, a back face wall which faces the front face wall, a first side wall which connects the front face wall and the back face wall, a second side wall which faces the first side wall and connects the front face wall and the back face wall, a top plate, and a bottom plate which faces the top plate, an injection port configured to inject ink into the storage chamber, and a partition wall connected to the first side wall and the second side wall, which extends from the top plate toward the bottom plate, wherein a first space surrounded by the back face wall, the first side wall, and the second side wall, and a second space surrounded by the front face wall, the first side wall, and the second side wall are formed by the partition wall, and wherein the injection port is arranged on a side of the first space, and a communication portion that communicates the first space and the second space is formed at a position between the partition wall and the bottom plate.

Further features of the present disclosure will become apparent from the following description of exemplary embodiments with reference to the attached drawings.

DESCRIPTION OF THE EMBODIMENTS

An exemplary embodiment of an ink jet recording apparatus according to the present disclosure will be described. Constituent elements described in the exemplary embodiment are merely examples and not intended to limit the scope of the present invention. In this specification, a serial-type ink jet recording apparatus will be described as an example. The serial-type ink jet recording apparatus executes recording by reciprocating a recording head for discharging ink on a recording medium conveyed intermittently, in a direction intersecting with the conveyance direction of the recording medium. However, the present disclosure is applicable not only to a serial-type ink jet recording apparatus but also to a line-type ink jet recording apparatus which continuously executes printing by using a full line printing head. In this specification, "ink" is used as a collective term of a liquid such as a recording liquid. Further, in this specification, "recording" refers not only to a recording operation executed on a planar object, but also to a recording operation executed on a solid object. In this specification, "recording medium" is used as a collective term of a recording medium such as a sheet, a fabric, a plastic film, a metallic plate, a glass, ceramics, wood, or leather to which a liquid is discharged. Further, the recording medium includes a roll-state continuous sheet as well as a cut sheet.

Figure 1:
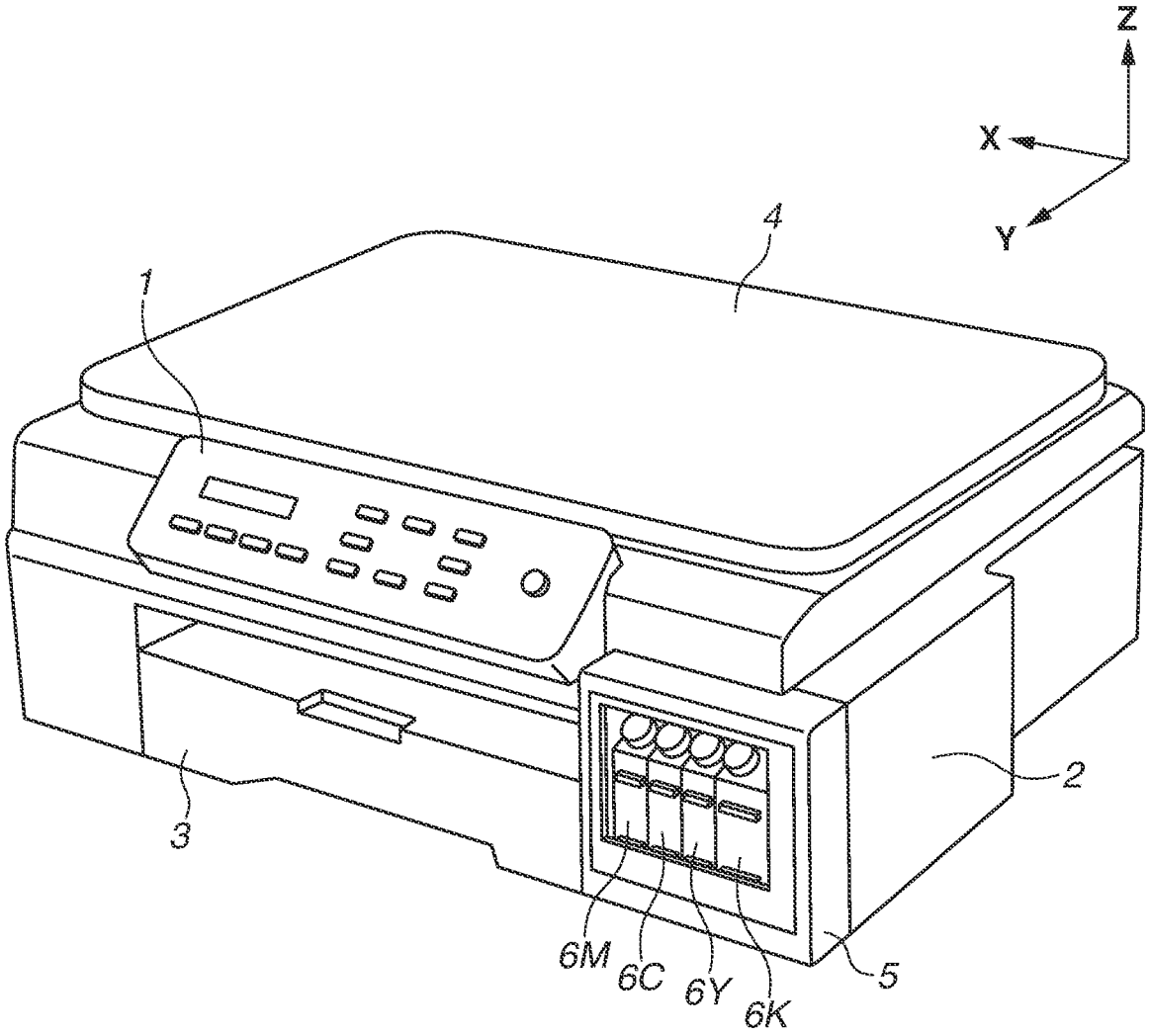
FIG. 1 is an external perspective diagram illustrating an ink jet recording apparatus according to a first exemplary embodiment.

FIG. 1 is a perspective diagram illustrating an external view of an ink jet recording apparatus (hereinafter, called as "recording apparatus") 2 in which ink tanks 6 (6M, 6C, 6Y and 6K) of the present exemplary embodiment are arranged. An operation panel 1 operable by a user is arranged on a front face of the recording apparatus 2, and a message is displayed to the user when ink has to be refilled to the ink tanks 6. A cassette 3 capable of storing recording media 11 (see FIG. 4) is arranged in an insertable/removable state on a lower side in a vertical direction (Z-direction) of the operation panel 1. The user can stack the recording media 11 in the cassette 3 by extracting the cassette 3 toward a front face side of the recording apparatus 2. Further, a document pressing plate 4 is arranged on the upper face of the recording apparatus 2, so that the user can set a document to be read by the recording apparatus 2. The Y-direction in FIG. 1 indicates a conveyance direction in which the recording media 11 are conveyed, and the X-direction indicates a width direction of the recording media 11. An upstream side of the Y-direction corresponds to a back face side of the recording apparatus 2, and a downstream side of the Y-direction corresponds to a front face side of the recording apparatus 2.

An operation to be performed when the user injects ink to the ink tanks 6 will be described with reference to FIGS. 2 and 3. The ink tanks 6 are arranged in the recording apparatus 2 at a position adjacent to the cassette 3. In the present exemplary embodiment, four ink tanks, i.e., a black ink tank 6K, a yellow ink tan 6Y, a cyan ink tank 6C, and a magenta ink tank 6M, are arranged independently. The number of ink tanks 6 or the number of colors of ink is not limited to the above, so that ink of three colors or less can be used, or ink of five colors or more can also be used by adding ink of another color thereto. The four ink tanks are collectively referred to as "ink tanks 6".

The recording apparatus 2 includes an ink tank cover 5 that rotatably moves to a position where the ink tanks 6 are covered and a position where the ink tanks 6 are exposed. In FIG. 1, the ink tank cover 5 is located at a position where the ink tanks 6 are covered thereby. In order to allow a user to check the amount of ink within the ink tanks 6 in the above state, an opening portion or a transparent member is attached to a front face of the ink tank cover 5.

Figure 2:
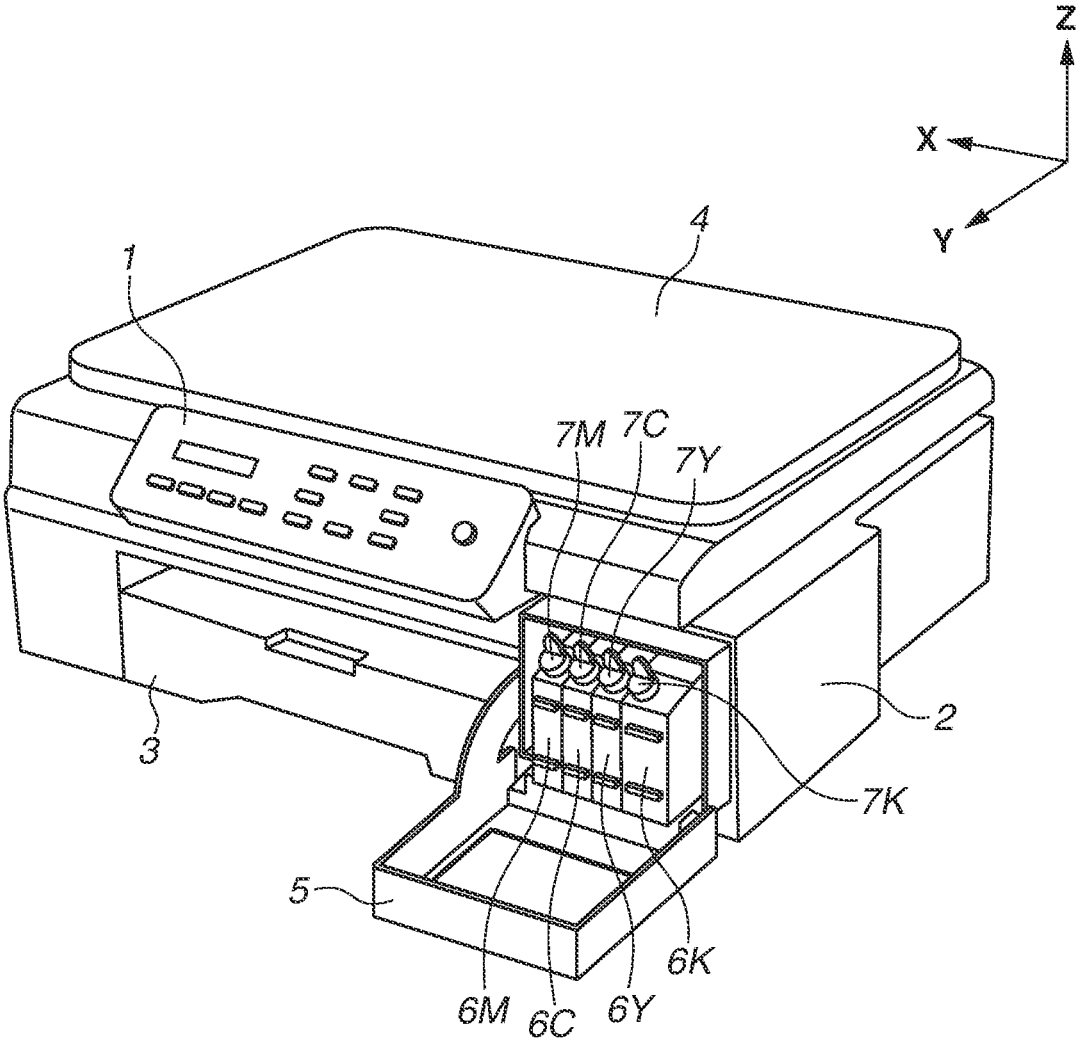
FIG. 2 is an external perspective diagram illustrating a state where a tank cover of the ink jet recording apparatus according to the first exemplary embodiment is opened.

FIG. 2 illustrates a state where the user rotates the ink tank cover 5 to a front face side by making a rotating shaft (not illustrated) as a center to expose the ink tanks 6. By rotating the ink tank cover 5, front faces and caps 7 of the ink tanks 6 are exposed. The caps 7 are respectively arranged on the ink tanks 6, and a black cap 7K, a yellow cap 7Y, a cyan cap 7C, and a magenta cap 7M are collectively called as "caps 7". The caps 7 close the ink injection ports (see FIG. 4) arranged on the upper portions of the ink tanks 6. When the user injects ink thereto, the user removes the cap 7 to open the ink injection port 19 and injects ink from an ink bottle 8. In FIG. 3, magenta ink is injected to the magenta ink tank 6M by the user. When injection of ink completes, the user closes the ink injection port 19 with the cap 7 again.

Figure 3:
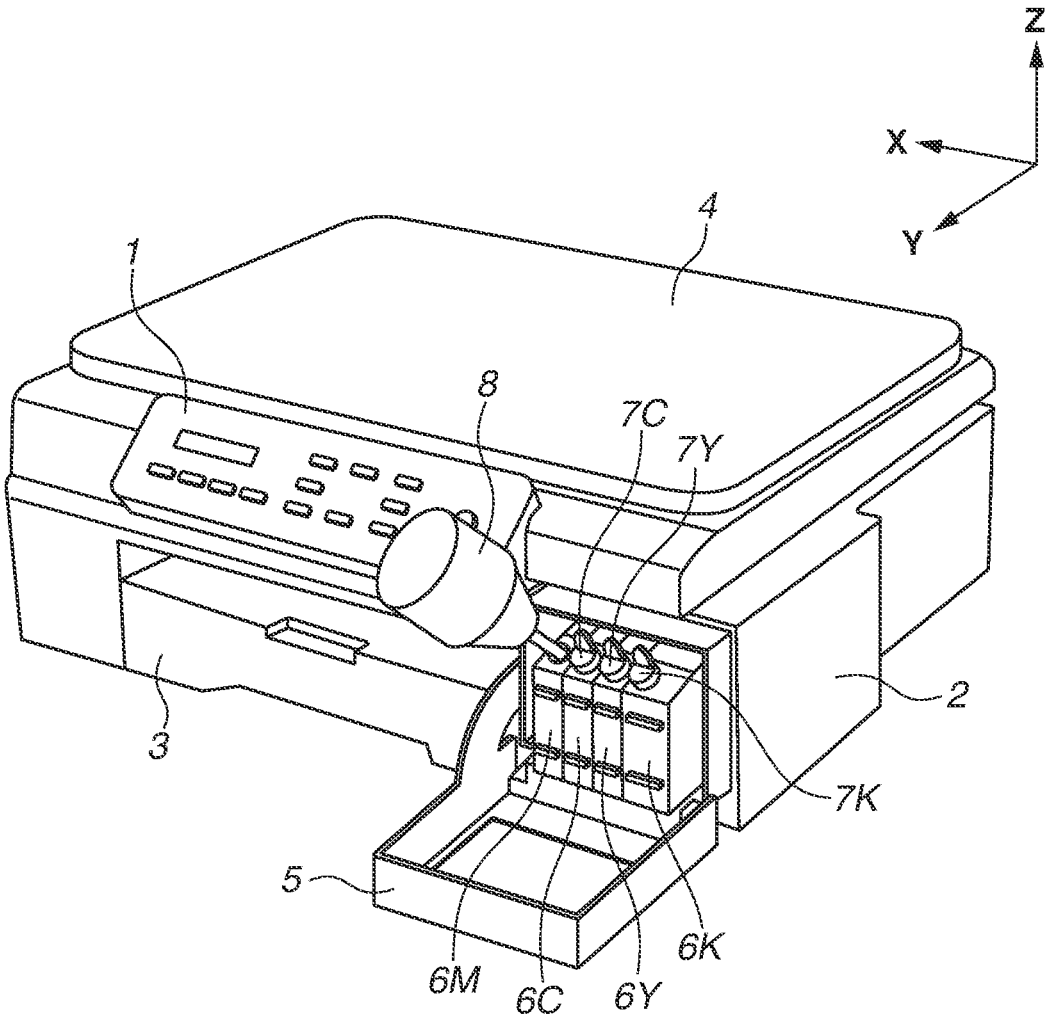
FIG. 3 is an external perspective diagram illustrating a state where ink is injected to an ink tank of the ink jet recording apparatus according to the first exemplary embodiment.
Figure 4:
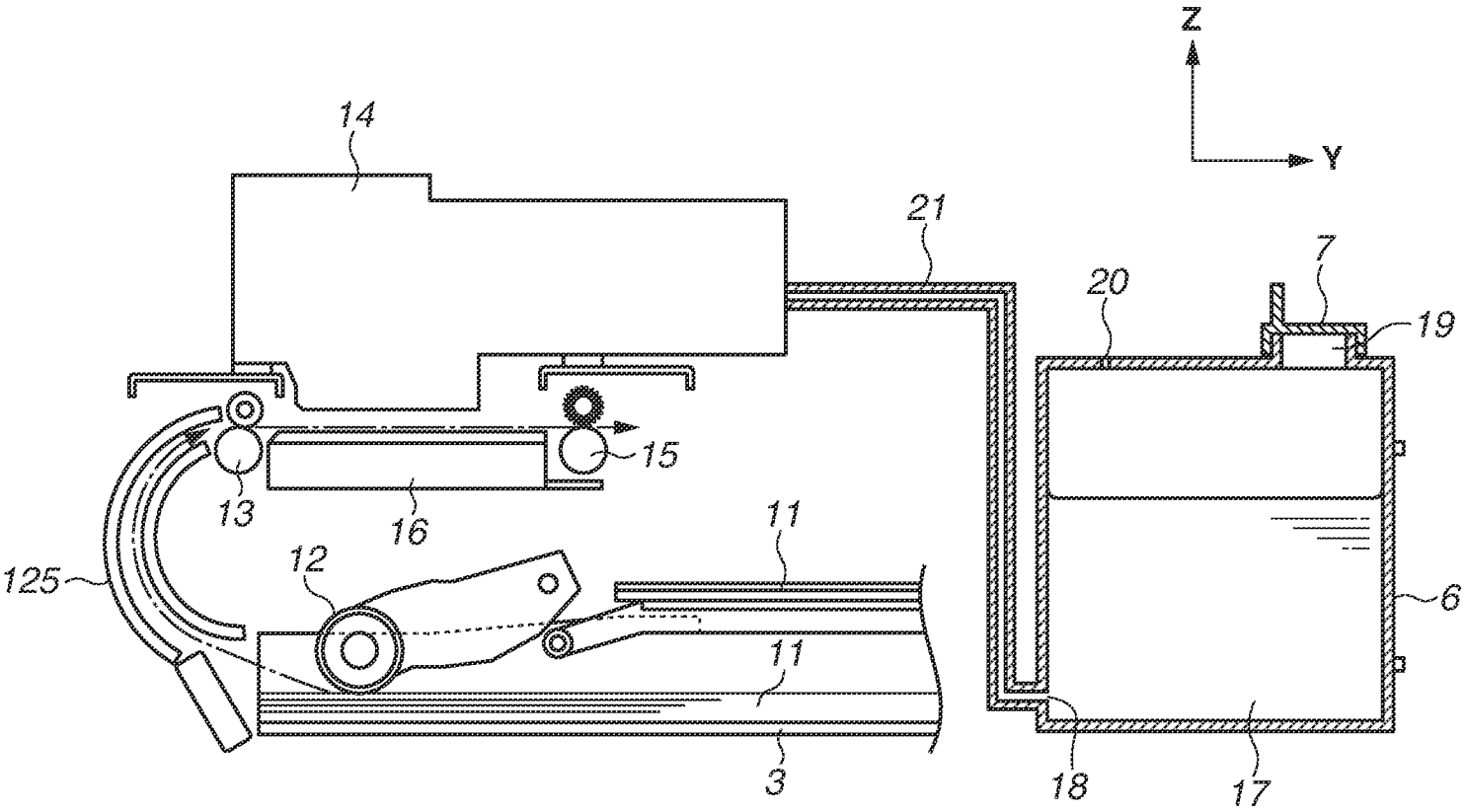
FIG. 4 is a cross-sectional diagram schematically illustrating an operation of the ink jet recording apparatus according to the first exemplary embodiment.

In FIGS. 1 to 3, the ink injection ports 19 are arranged on the inclined faces on the upper portions of the ink tanks 6. However, the configuration is not limited to the above, and the ink injection ports 19 can be arranged on the top faces of the ink tanks 6. In FIG. 4 and subsequent drawings, an ink tank 6 having an ink injection port 19 on a top face thereof will be described as an example.

An operation of the recording apparatus 2 will be described with reference to FIG. 4. FIG. 4 is a schematic cross-sectional diagram of the recording apparatus 2 which illustrates only an ink tank 6 of one color for the sake of convenience. The ink tank 6 retains ink 17, and an ink supply port 18 and an air communication opening 20 are arranged thereon in addition to the ink injection port 19. The ink supply port 18 is arranged at the lower portion of the ink tank 6, and connected to an ink supply path 21 consisting of a flexible tube, so that the ink 17 within the ink tank 6 can be supplied to a recording head 14. The air communication opening 20 is arranged at the upper portion of the ink tank 6 to make the ink tank 6 communicate with the atmosphere in order to keep the internal and the external atmospheric pressures equal to each other. Ink is supplied to the recording head 14 from the ink tank 6 by using a water head difference of the ink.

A recording medium stacked on the top of the recording media 11 stacked on the cassette 3 is fed along with the rotation of a feeding roller 12 abutting thereon. The fed recording medium 11 passes through a curved conveyance path 125 to reach a conveyance roller 13. Then, ink is discharged from the recording head 14 while the recording medium 11 is being conveyed by the conveyance roller 13, so that recording is executed thereon. The recording medium 11 on which recording completes is discharged to the outside of the recording apparatus 2 by a discharge roller 15. A platen 16 is arranged at a position between the conveyance roller 13 and the discharge roller 15 where the platen 16 faces the recording head 14. The platen 16 supports a back surface of the recording medium 11 to be recorded by the recording head 14.

Figure 5:
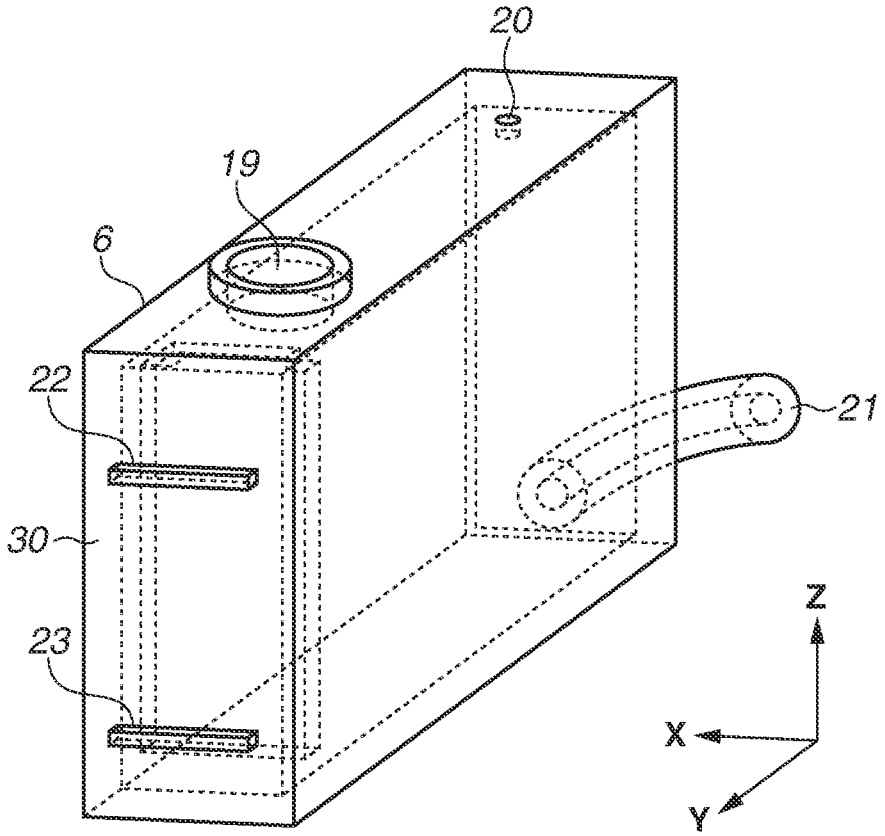
FIG. 5 is an external perspective diagram of the ink tank according to the first exemplary embodiment.
Figure 6:
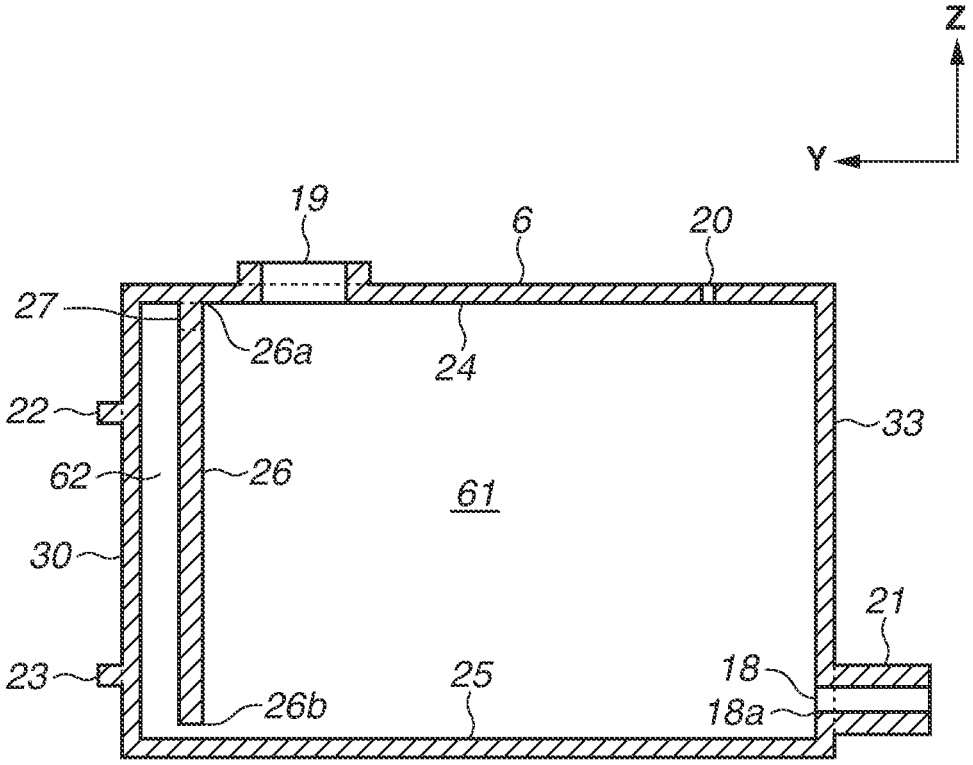
FIG. 6 is a cross-sectional diagram in the Y-direction of the ink tank according to the first exemplary embodiment.
Figure 7:
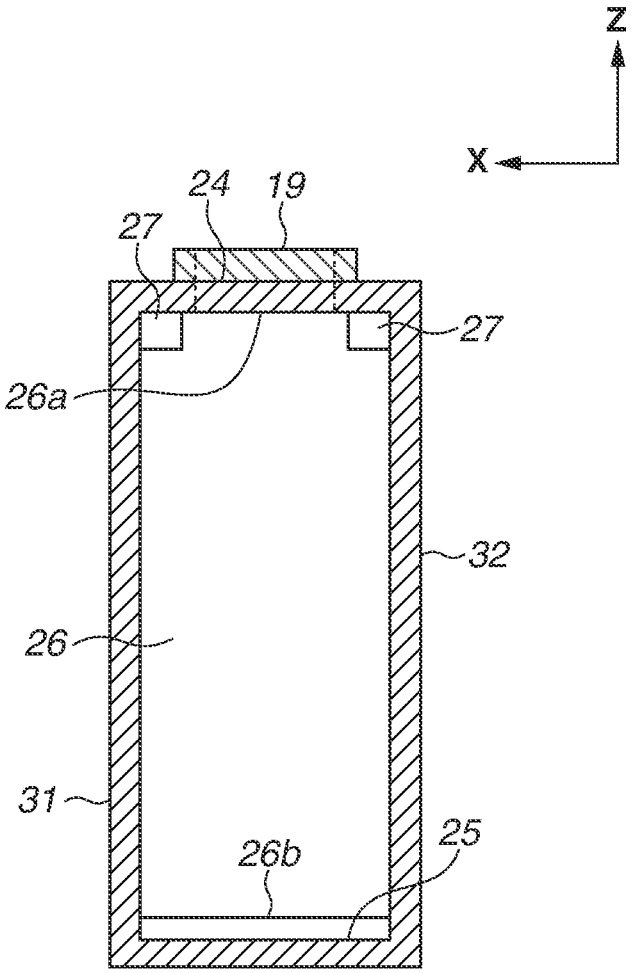
FIG. 7 is a cross-sectional diagram in the X-direction of the ink tank according to the first exemplary embodiment.

The ink tank 6 of the present exemplary embodiment will be described with reference to FIGS. 5 to 9. FIG. 5 is an external perspective diagram of the ink tank 6, FIG. 6 is a cross-sectional diagram in the Y-direction of the ink tank 6, and FIG. 7 is a cross-sectional diagram in the X-direction of the ink tank 6 viewed from a front face side. The ink tank 6 has a visual recognition wall (front wall) 30 on the front face side, so that a user can check an amount of ink within the ink tank 6. An upper limit index 22 for indicating a full state of ink and a lower limit index 23 for indicating a decreased state of ink and prompting the user to refill ink are arranged on the visual recognition wall 30. The ink tank 6 includes a rear face wall 33 that faces the visual recognition wall 30, a first side wall 31, a second side wall 32, a top plate 24 that demarcates an upper end, and a bottom plate 25 that demarcates a lower end in addition to the visual recognition wall 30, so that a storage chamber capable of reserving ink 17 is formed thereby. The first side wall 31 faces the second side wall 32, and the top plate 24 faces the bottom plate 25.

A partition wall 26 extending vertically downward from the top plate 24 is arranged on the internal portion (storage chamber) of the ink tank 6 (see FIG. 6). The partition wall 26 divides the storage chamber of the ink tank 6 into a space on a side of the rear face wall 33 and a space on a side of a visual recognition wall (front face wall) 30 in the horizontal direction. The partition wall 26 is arranged on a downstream side of the ink injection port 19 in the Y-direction, and connected to the first side wall 31 and the second side wall 32 in the X-direction (see FIG. 7). Further, the partition wall 26 is arranged to have a predetermined space between the partition wall 26 and the visual recognition wall 30. A gap as a communication portion which makes ink 17 be movable is formed at a position between the partition wall 26 and the bottom plate 25. A lower end 26*b* of the partition wall 26 is located vertically lower than the lower end portion 18*a* of the ink supply port 18. The lower limit index 23 is arranged at a position vertically higher than the ink supply port 18. The partition wall 26 does not always have to be connected to the top plate 24, but can be connected to the visual recognition wall 30 as long as the partition wall 26 is connected thereto at a position vertically higher than the upper limit index 22. Further, the partition wall 26 and the bottom plate 25 can be partially connected to each other as long as a communicable communication portion is arranged thereon.

As illustrated in FIGS. 6 and 7, a hole (communication portion) 27 is formed on the partition wall 26 at a position in a vicinity of the end portion on a side of the top plate 24. In the present exemplary embodiment, as illustrated in FIG. 7, two holes 27 are arranged on a side of the first side wall 31 and a side of the second side wall 32. The holes 27 are arranged at positions vertically higher than the upper limit index 22. The holes 27 make the atmosphere (air) in a space formed by the partition wall 26 and the visual recognition wall 30 and the atmosphere in a space formed by the partition wall 26 and the rear face wall 33 communicate with each other. With this configuration, the atmospheric pressures in the two spaces can be maintained at an equivalent level, and the ink 17 retained in the two spaces can be maintained at an equal liquid level. In addition, the hole 27 can be arranged as a gap which is formed by disconnecting the upper end 26*a* as a vertical upper end portion of the partition wall 26 from the top plate 24. Hereinafter, a space formed by the partition wall 26 and the rear face wall 33 is called as a first space 61, and a space formed by the partition wall 26 and the visual recognition wall 30 is called as a second space 62.

Figure 8A:
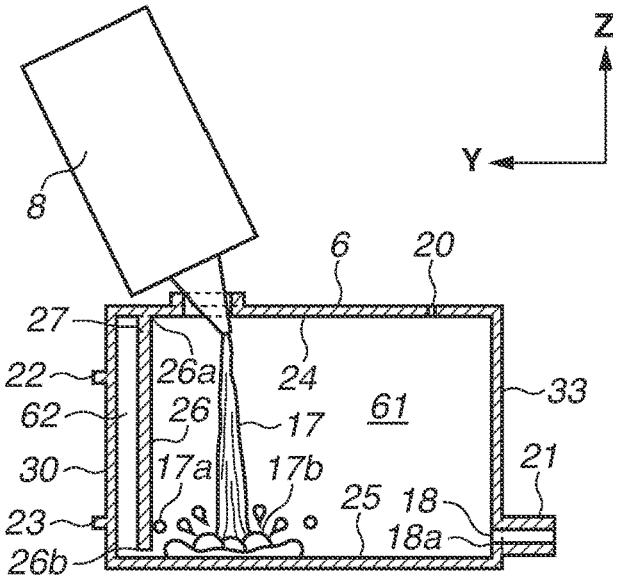
FIGS. 8A, 8B, and 8C are cross-sectional diagrams in the Y-direction, which illustrate a state where ink is injected to the ink tank according to the first exemplary embodiment.
Figure 8B:
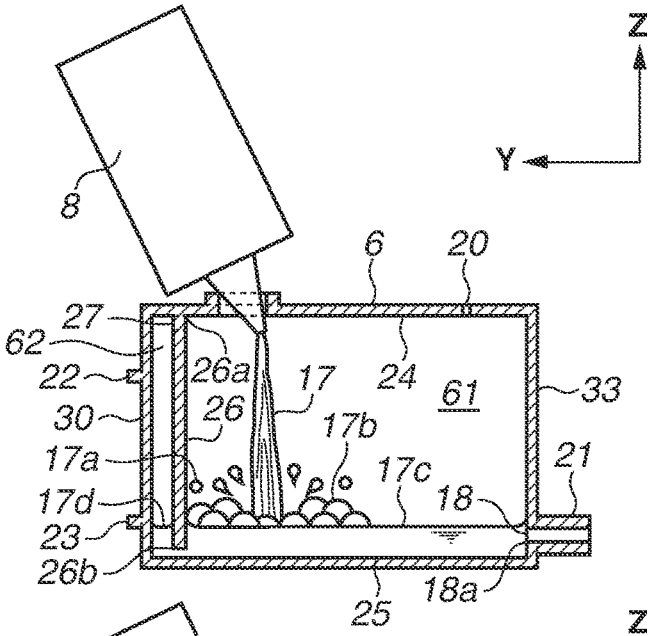
Figure 8C:
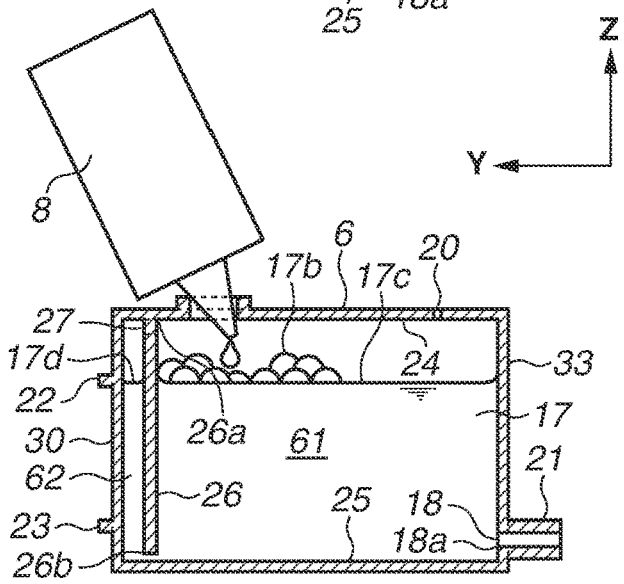

FIGS. 8A to 8C are cross-sectional diagrams of the ink tank 6 in the Y-direction, which illustrate a state where the ink 17 is injected from an ink bottle 8 by the user. In FIG. 8A, the user starts injecting ink from the ink bottle 8 in a state where the ink 17 has not been injected to the ink tank 6. Because the ink injection port 19 is arranged on a side of the first space 61, the injected ink 17 firstly enters the first space 61. When the ink 17 injected from the ink bottle 8 has reached the bottom plate 25, spattered ink 17*a* and air bubbles 17*b* are generated because of an impact of injection. At this time, because the partition wall 26 is arranged, the spattered ink 17*a* and air bubbles 17*b* generated from the injected ink 17 adhere to the partition wall 26. With this configuration, the spattered ink 17*a* and the air bubbles 17*b* are suppressed from adhering to the visual recognition wall 30.

In FIG. 8B, from the state illustrated in FIG. 8A, the ink 17 is further injected by the user. The ink 17 passes through a gap (communication portion) formed at a position between the partition wall 26 and the bottom plate 25, and moves to the second space 62 from the first space 61. The gap formed at a position between the lower end 26*b* of the partition wall 26 and the bottom plate 25 has such a size that the air bubbles 17*b* generated on a ink surface 17*c* cannot pass through. In other words, because the air bubbles 17*b* are suppressed from moving into the second space 62 by the partition wall 26, the air bubbles 17*b* rarely exist in the second space 62, so that the user can clearly see the ink surface 17*d* in the second space 62 through the visual recognition wall 30. As described above, as the ink surface 17*c* in the first space 61 and the ink surface 17*d* in the second space 62 equivalently fluctuate according to the injection of ink, the user can precisely check the amount of ink within the ink tank 6.

In FIG. 8C, the ink 17 is continuously injected from a state in FIG. 8B, so that a liquid surface has reached the upper limit index 22. As described above, spattered ink 17*a* and air bubbles 17*b* generated from the injected ink 17 are prevented from moving into the second space 62 by the partition wall 26, so as to stay within the first space 61. With this configuration, the spattered ink 17*a* and the air bubbles 17*b* are prevented from adhering to the visual recognition wall 30, so that the user can see the amount of ink within the ink tank 6 more precisely.

Figure 9:
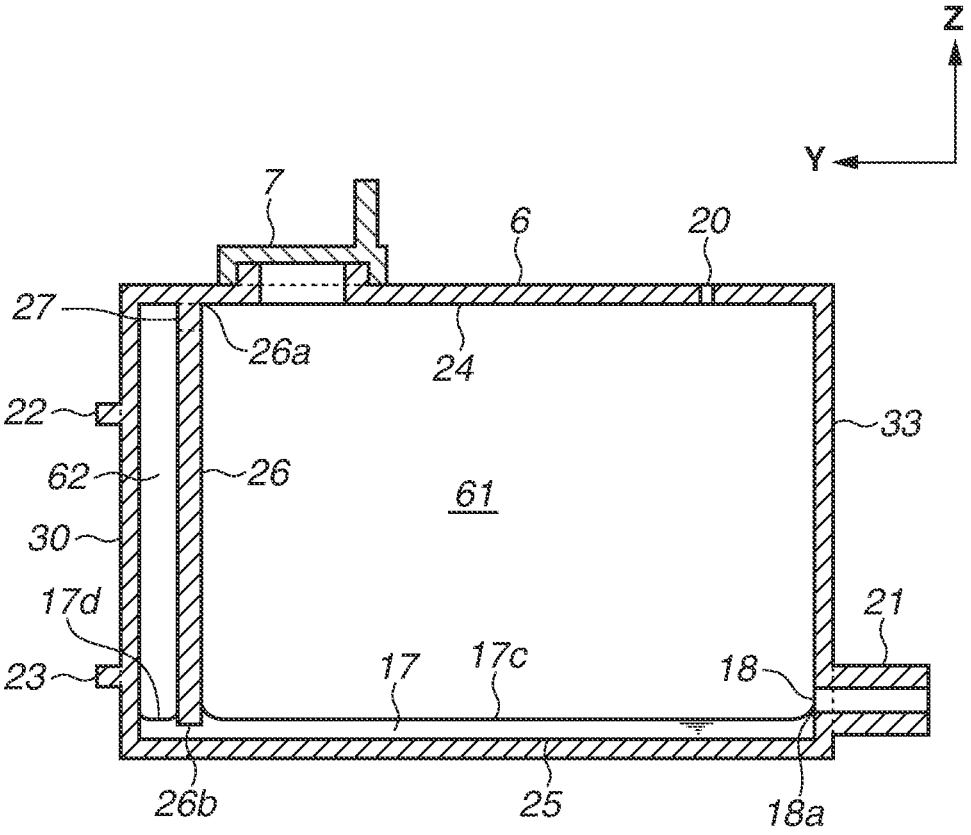
FIG. 9 is a cross-sectional diagram in the Y-direction of the ink tank according to the first exemplary embodiment, which illustrates a state where supply of ink to a recording head stops.

FIG. 9 illustrates a state where an amount of ink within the ink tank 6 is reduced by the ink supplied to the recording head 14, so that the ink surface 17*d* and the ink surface 17*c* are located at a position lower than the lower end portion 18*a* of the ink supply port 18 as well as the lower limit index 23. In other words, FIG. 9 illustrates a state where supply of ink to the recording head 14 stops because ink is not injected to the ink tank 6 by the user even though a position of the ink surface 17*d* has become lower than the lower limit index 23. Since the lower end portion 18*a* of the ink supply port 18 is located vertically higher than the lower end 26*b* of the partition wall 26, the ink surfaces 17*c* and 17*d* are located higher than the lower end 26*b* of the partition wall 26 even in a state where supply of ink stops. Therefore, even if the air bubbles 17*b* exist in the ink surface 17*c* in the first space 61, the air bubbles 17*b* are prevented from moving into the second space 62 because the gap between the lower end 26*b* and the bottom plate 25 is filled with ink, and the gap is located lower than the ink surface 17*c*. Accordingly, the air bubbles 17*b* can be prevented from adhering to the visual recognition wall 30 regardless of the amount of ink within the ink tank 6.

Figure 10:
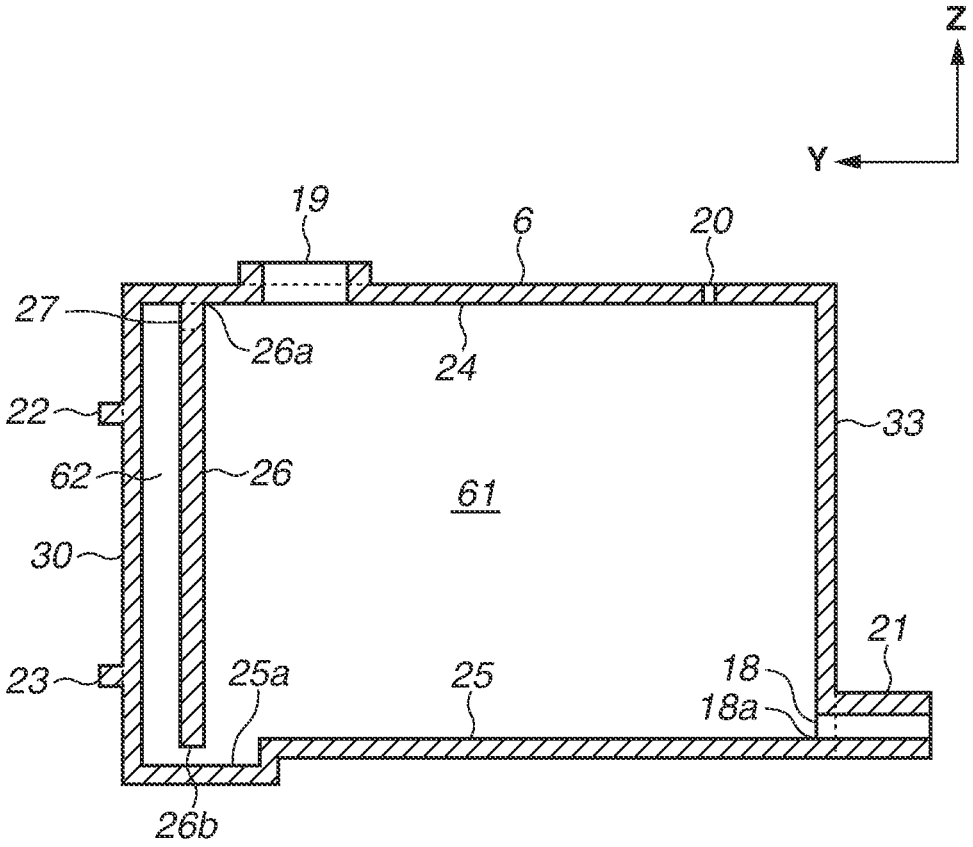
FIG. 10 is a cross-sectional diagram in the Y-direction of an ink tank according to a second exemplary embodiment.

A second exemplary embodiment will be described with reference to FIGS. 10 to 12. FIG. 10 is a cross-sectional diagram in the Y-direction of an ink tank 6 of the present exemplary embodiment. A bottom plate 25 of the present exemplary embodiment is different from that of the first exemplary embodiment in that a lower area 25*a* facing a partition wall 26 is located vertically lower than another area of the bottom plate 25. Because of this configuration, a lower end 26*b* of the partition wall 26 is located vertically lower than the bottom plate 25. Similar to the first exemplary embodiment, a gap (communication portion) which enables the ink 17 to move between a first space 61 and a second space 62 is formed at a position between the lower end 26*b* of the partition wall 26 and the lower area 25*a*. Further, a lower end portion 18*a* of an ink supply port 18 is located at a height the same as a height of the bottom plate 25 in the vertical direction.

Figure 11:
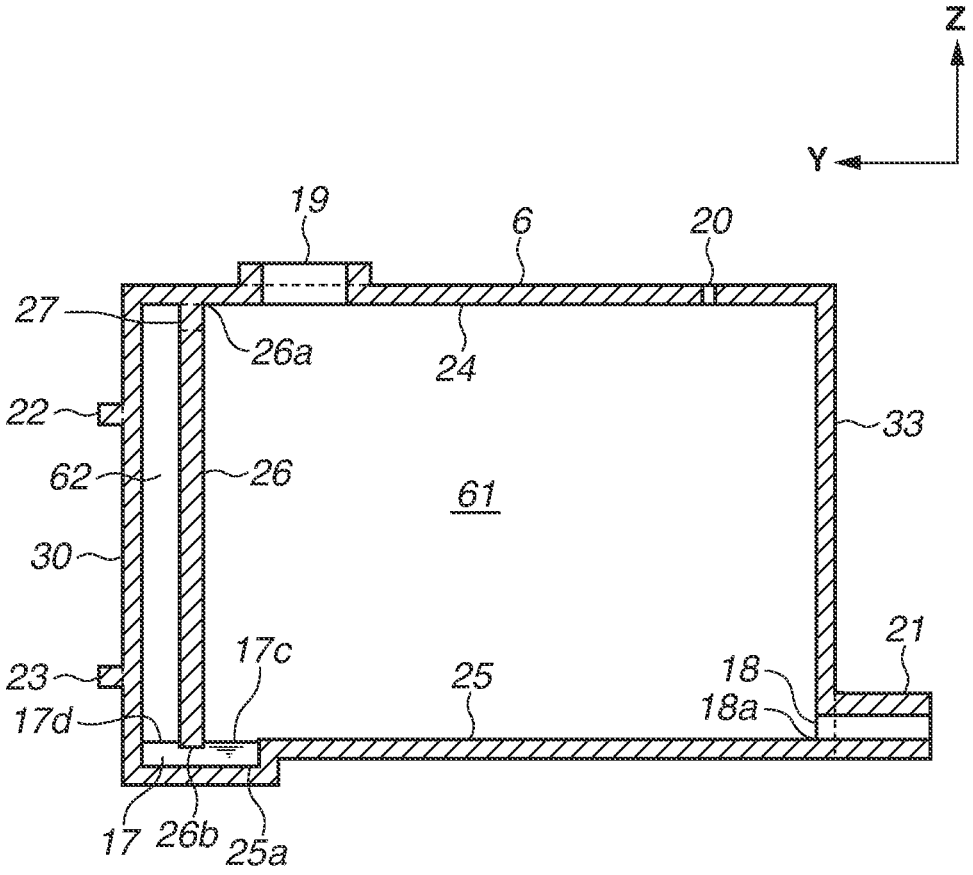
FIG. 11 is a cross-sectional diagram in the Y-direction of the ink tank according to the second exemplary embodiment, which illustrates a state where supply of ink to the recording head stops.

FIG. 11 is a cross-sectional diagram corresponding to the cross-sectional diagram in FIG. 9 in the first exemplary embodiment, which illustrates a state where supply of ink to a recording head 14 stops because the amount of ink within the ink tank 6 is reduced. Because the lower end portion 18*a* of the ink supply port 18 is located at a height the same as a height of the bottom plate 25, supply of ink continues up to the height of the bottom plate 25, and ink remains in the lower area 25*a* located lower than the bottom plate 25 when supply of ink stops. Therefore, the amount of ink remaining in the ink tank 6 can be less than that of the first exemplary embodiment. Further, similar to the first exemplary embodiment, since the ink surfaces 17*c* and 17*d* are located vertically higher than the lower end 26*b* of the partition wall 26 in the lower area 25*a*, the air bubbles 17*b* generated in the first space 61 are suppressed from moving into the second space 62.

Figure 12:
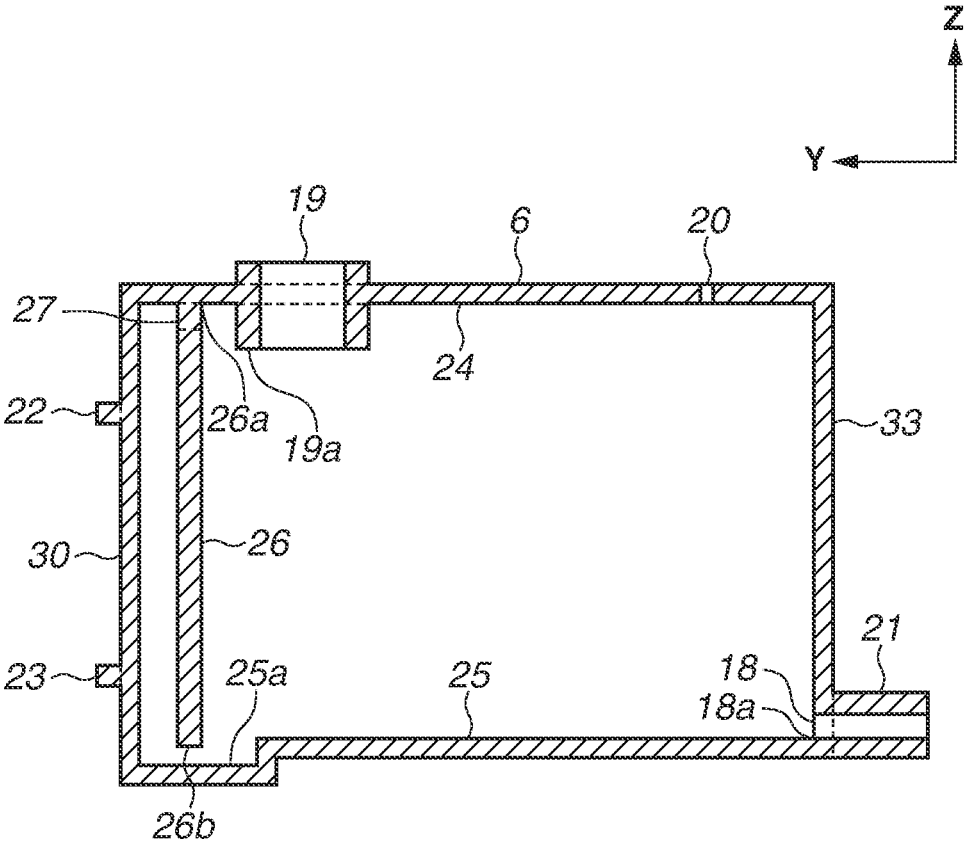
FIG. 12 is a cross-sectional diagram in the Y-direction of an ink tank of a variation example according to the second exemplary embodiment.

FIG. 12 is a cross-sectional diagram in the Y-direction illustrating a configuration as a variation example of the present exemplary embodiment, in which a lower end 19*a* of an ink injection port 19 is vertically extended downward. The lower end 19*a* of the ink injection port 19 is located vertically lower than a hole 27 arranged on the partition wall 26. With this configuration, the injected ink can be suppressed from being in contact with the hole 27, and thus the hole 27 can be prevented from being clogged therewith. In addition, the present exemplary embodiment can also be employed to the first exemplary embodiment.

Figure 13:
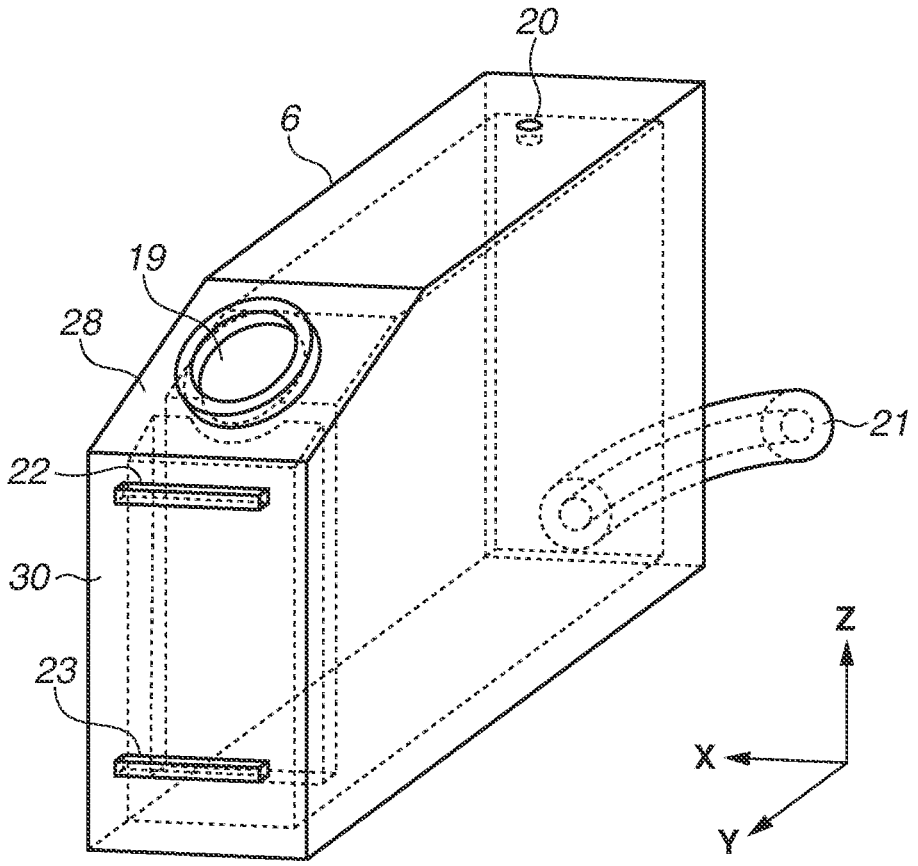
FIG. 13 is an external perspective diagram of an ink tank according to a third exemplary embodiment.
Figure 14:
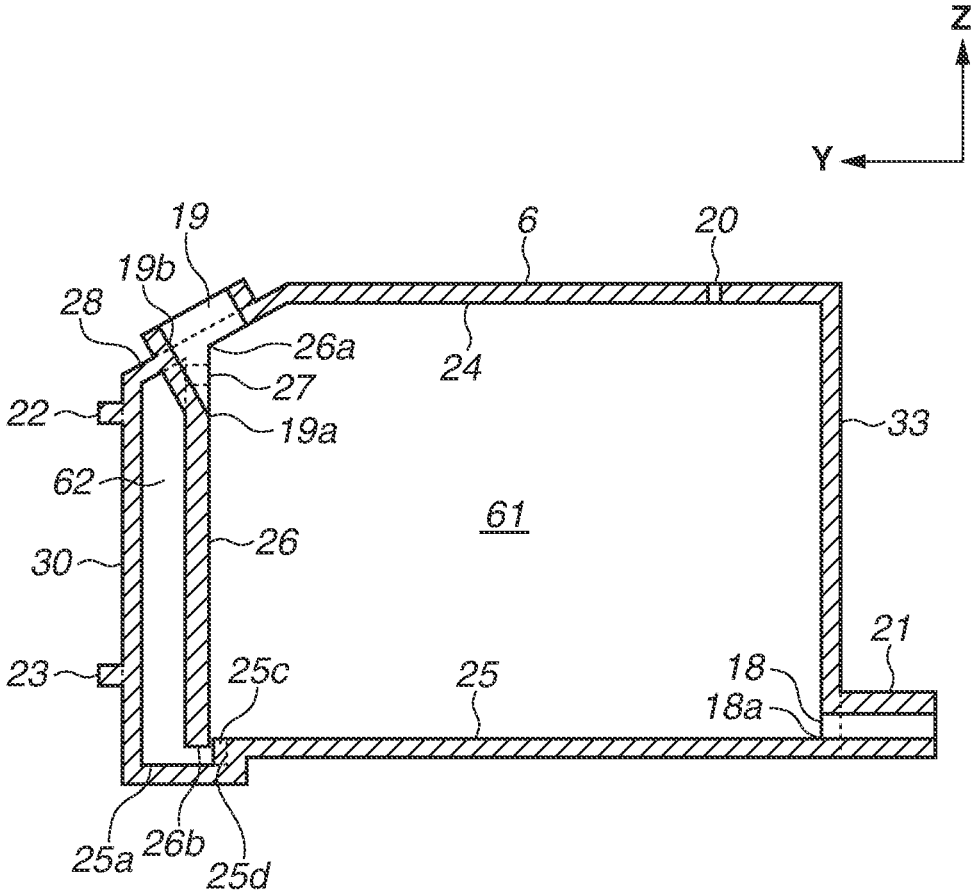
FIG. 14 is a cross-sectional diagram in the Y-direction of the ink tank according to the third exemplary embodiment.
Figure 15:
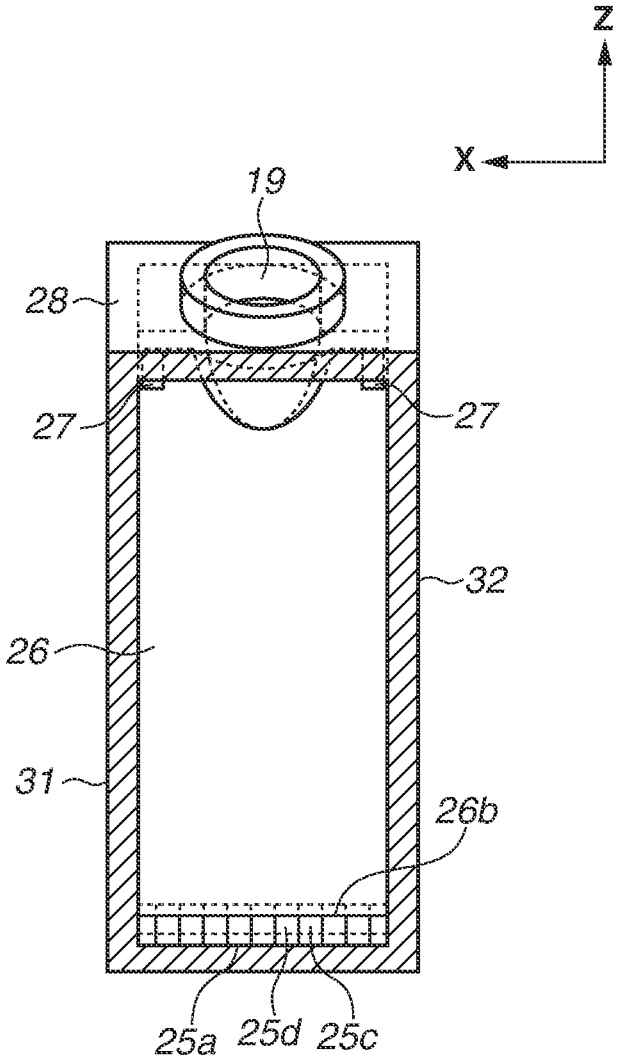
FIG. 15 is a cross-sectional diagram in the X-direction of the ink tank according to the third exemplary embodiment.
Figure 16:
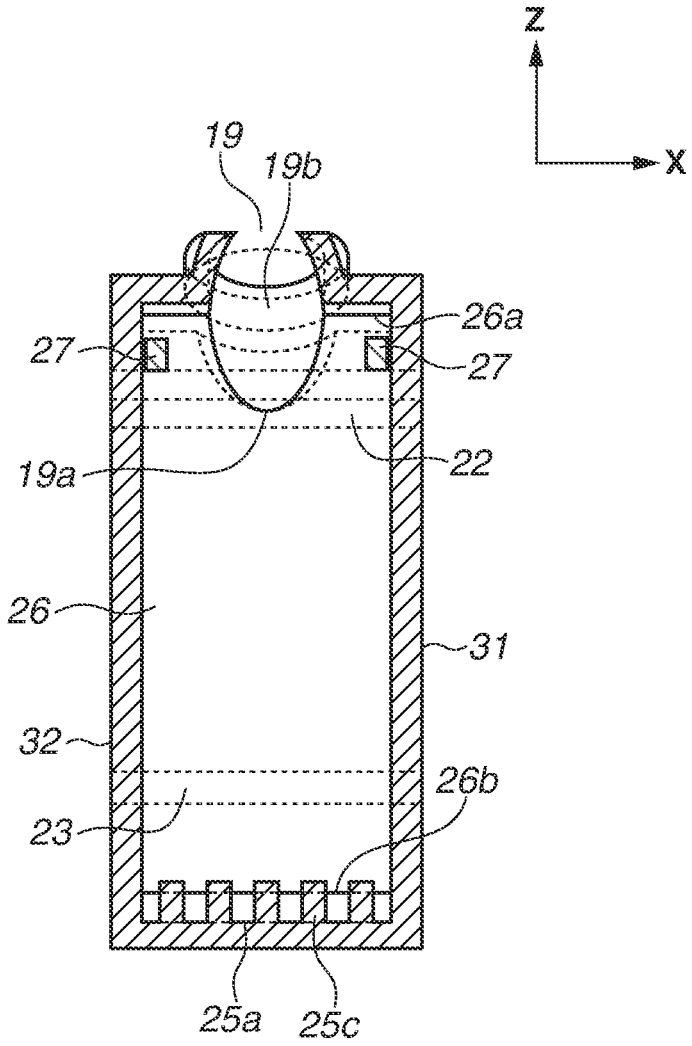
FIG. 16 is a cross-sectional diagram in the X-direction of the ink tank according to the third exemplary embodiment viewed from a back face.

A third exemplary embodiment will be described with reference to FIGS. 13 to 16. FIG. 13 is an external perspective diagram of an ink tank 6 of the present exemplary embodiment, FIG. 14 is a cross-sectional diagram in the Y-direction of the ink tank 6, and FIG. 15 is a cross-sectional diagram in the X-direction of the ink tank 6 viewed from a front face side. FIG. 16 is a cross-sectional diagram in the X-direction, which illustrates a vicinity of a partition wall 26 in FIG. 13 viewed from a back face side.

In the present exemplary embodiment, as illustrated in FIGS. 1 to 3, an ink injection port 19 is arranged on an inclined face 28 on the upper portion of the ink tank 6. Because the ink injection port 19 is opened obliquely upward, the user can inject ink more easily. In comparison to the first and the second exemplary embodiments, the ink injection port 19 and a visual recognition wall 30 are arranged close to each other, and in the present exemplary embodiment, the ink injection port 19 and the partition wall 26 are integrally configured.

As illustrated in FIG. 16, an upper end 26*a* of the partition wall 26 is connected to the inclined face 28, and two holes 27 are arranged on the upper portion thereof. The ink injection port 19 has a side wall portion 19*b* extending in a direction substantially vertical to the inclined face 28, and a lower end 19*a* of the ink injection port 19 is located vertically lower than the holes 27 (see FIG. 14). Because the side wall portion 19*b* of the ink injection port 19 and the partition wall 26 are connected to each other, the side wall portion 19*b* and the partition wall 26 divides the inner portion of the ink tank 6 into a first space 61 and a second space 62.

Similar to the second exemplary embodiment, an lower area 25*a* of a bottom plate 25 which faces the partition wall 26 is located vertically lower than another area of the bottom plate 25. Further, in the present exemplary embodiment, pectinate ribs 25*c* are arranged on a boundary portion 25*d* between the lower area 25*a* and another area of the bottom plate 25. The pectinate ribs 25 are formed to extend upward in the vertical direction. By arranging the pectinate ribs 25*c*, air bubbles 17*b* generated in the first space 61 can be prevented from passing through a gap between the partition wall 26 and the lower area 25*a*. By increasing the number of ribs 25*c* to be arranged thereon, the above-described effect can also be achieved with respect to tiny air bubbles 17*b*. In addition, the ribs 25*c* of the present exemplary embodiment can also be employed to the configuration in the second exemplary embodiment.

Figure 17:
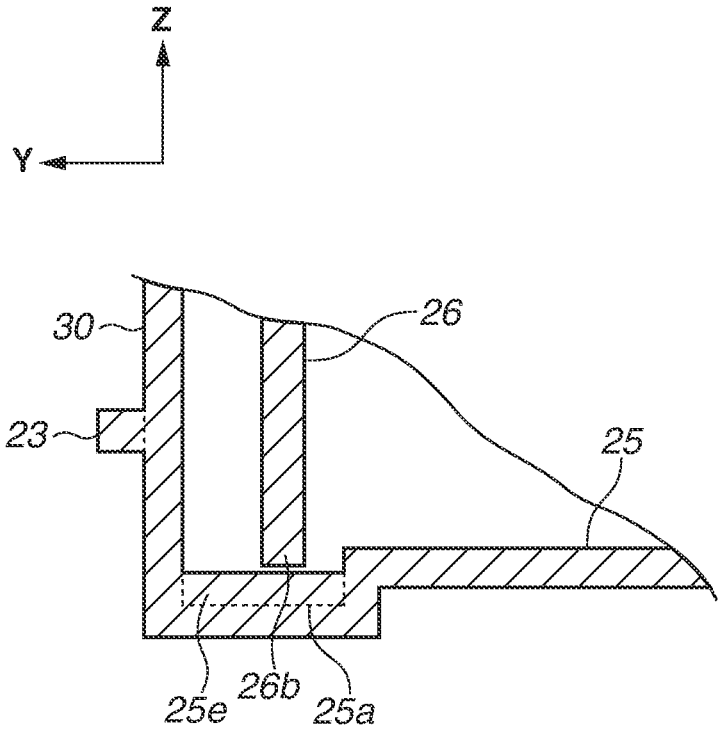
FIG. 17 is a cross-sectional diagram in the Y-direction of an ink tank of a variation example according to the third exemplary embodiment.
Figure 18:
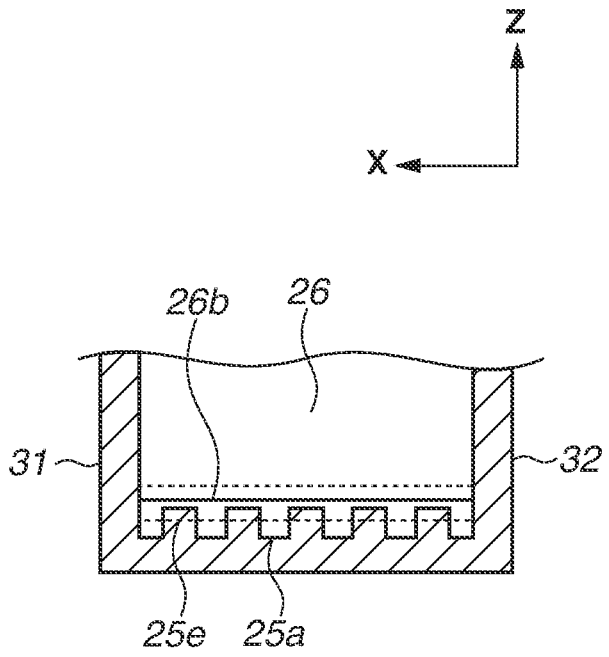
FIG. 18 is a cross-sectional diagram in the X-direction of an ink tank of a variation example according to the third exemplary embodiment.
Figure 19:
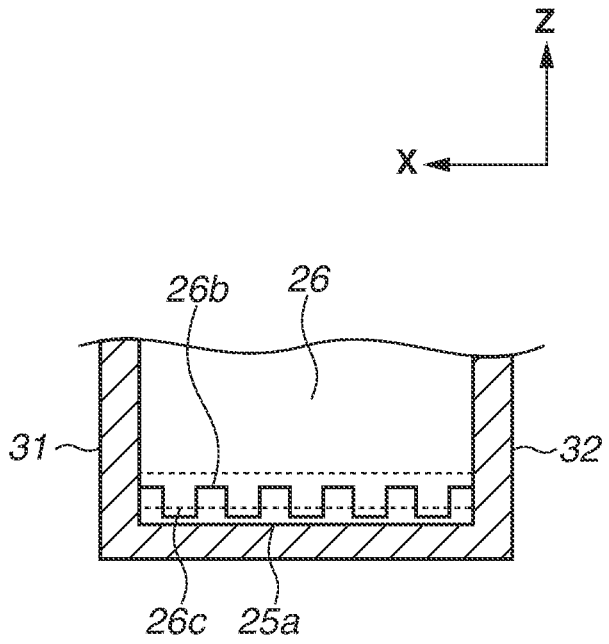
FIG. 19 is a cross-sectional diagram in the X-direction of an ink tank of a variation example according to the third exemplary embodiment.

Variation examples of the ribs 25*c* in the present exemplary embodiment will be described with reference to FIGS. 17 to 19. FIG. 17 is a cross-sectional diagram in the Y-direction illustrating a vicinity of a lower end 26*b* of the partition wall 26, and FIG. 18 is a cross-sectional diagram in the X-direction viewed from a front face side thereof. In the configuration described in the third exemplary embodiment, the ribs 25*c* extending in the vertical direction are arranged thereon. However, in the example illustrated in FIGS. 17 and 18, ribs 25*e* extending in the horizontal direction are arranged on the entire lower area 25*a*. FIG. 19 is a cross-sectional diagram in the X-direction viewed from the front face, which illustrates a configuration in which ribs 26*c* are arranged on the lower end 26*b* of the partition wall 26. In both of the variation examples, by arranging the ribs on a gap between the partition wall 26 and the bottom plate 25, a cross-sectional area of the gap through which the ink 17 passes to move from the first space 61 to the second space 62 is reduced, so that passage of tiny air bubbles 17*b* can also be suppressed.

In other words, according to the present disclosure, it is possible to provide an ink jet recording apparatus capable of suppressing the lowering of visibility of a liquid surface of ink retained in the ink tank, which is caused by air bubbles generated when ink is injected from the injection port.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-167755, filed Aug. 31, 2017, which is hereby incorporated by reference herein in its entirety.

What is claimed is:

1. An ink tank comprising:

a storage chamber formed of a front wall, a back wall which faces the front wall, a first side wall which connects the front wall and the back wall, a second side wall which faces the first side wall and connects the front wall and the back wall, a top plate, and a bottom plate which faces the top plate;

an injection port configured to inject ink into the storage chamber;

a partition wall provided between the injection port and the front wall, connected to the first side wall and the second side wall, and extended from the top plate toward the bottom plate, wherein the storage chamber is divided by the partition wall into a first space in which the injection port is provided and a second space at which the front wall is arranged;

a communication portion that communicates the first space and the second space and that is arranged at a position between the lower end of the partition wall and the bottom plate;

a supply port configured to supply ink within the storage chamber to an external portion of the ink tank, a lower end of the supply port is located higher than the lower end of the partition wall; and a lower limit index for prompting a user to refill ink, arranged on the front wall and located higher than the supply port.

2. The ink tank according to claim 1, wherein a second communication portion that communicates the first space and the second space is arranged in a vicinity of the top plate.

3. The ink tank according to claim 1, wherein pectinate ribs are arranged at a position between the partition wall and the bottom plate.

4. An ink jet recording apparatus including a recording head configured to discharge ink and an ink tank configured to storage ink to be supplied to the recording head, the ink tank comprising:

a storage chamber formed of a front wall, a back wall which faces the front wall, a first side wall which connects the front wall and the back wall, a second side wall which faces the first side wall and connects the front wall and the back wall, a top plate, and a bottom plate which faces the top plate;

an injection port configured to inject ink into the storage chamber; and a partition wall provided between the injection port and the front wall, connected to the first side wall and the second side wall, and extended from the top plate toward the bottom plate, wherein the storage chamber is divided by the partition wall into a first space in which the injection port is provided and a second space at which the front wall is arranged;

a communication portion that communicates the first space and the second space and that is arranged at a position between the lower end of the partition wall and the bottom plate;

a supply port configured to supply ink within the storage chamber to an external portion of the ink tank, a lower end of the supply port is located higher than the lower end of the partition wall; and a lower limit index for prompting a user to refill ink, arranged on the front wall and located higher than the supply port.

5. The ink jet recording apparatus according to claim 4, wherein a second communication portion that communicates the first space and the second space is arranged in a vicinity of the top plate.

6. The ink jet recording apparatus according to claim 4, wherein the bottom plate includes a first bottom surface provided in the first space and a second bottom surface provided to face the partition wall, wherein the second bottom surface is lower than the first bottom surface, and wherein the lower end of the supply port is provided at a same height as the first bottom surface.

7. The ink jet recording apparatus according to claim 4, wherein pectinate ribs are arranged at a position between the partition wall and the bottom plate.

8. An ink tank comprising:

a storage chamber formed of a front wall, a back wall which faces the front wall, a first side wall which connects the front wall and the back wall, a second side wall which faces the first side wall and connects the front wall and the back wall, a top plate, and a bottom plate which faces the top plate;

an injection port configured to inject ink into the storage chamber;

a partition wall provided between the injection port and the front wall, connected to the first side wall and the second side wall, and extended from the top plate toward the bottom plate, wherein the storage chamber is divided by the partition wall into a first space in which the injection port is provided and a second space at which the front wall is arranged;

a communication portion that communicates the first space and the second space and that is arranged at a position between the lower end of the partition wall and the bottom plate;

a supply port configured to supply ink within the storage chamber to an external portion of the ink tank, a lower end of the supply port is located higher than the lower end of the partition wall; and wherein the bottom plate includes a first bottom surface provided in the first space and a second bottom surface provided to face the partition wall, wherein the second bottom surface is lower than the first bottom surface, and wherein the lower end of the supply port is provided at a same height as the first bottom surface.

9. The ink tank according to claim 8, wherein a second communication portion that communicates the first space and the second space is arranged in a vicinity of the top plate.

10. The ink tank according to claim 8, wherein pectinate ribs are arranged at a position between the partition wall and the bottom plate.

* * * * *